US007036244B1

(12) United States Patent
Finch

(10) Patent No.: US 7,036,244 B1
(45) Date of Patent: May 2, 2006

(54) RIGID ARTICULATED POINTE SHOE

(76) Inventor: Dennis Finch, 33 E. Hudson Ave., Englewood, NJ (US) 07631

( * ) Notice: Subject to any disclaimer, the term of this patent is extended or adjusted under 35 U.S.C. 154(b) by 85 days.

(21) Appl. No.: 10/614,142

(22) Filed: Jul. 7, 2003

(51) Int. Cl.
*A43B 5/12* (2006.01)

(52) U.S. Cl. ..... 36/8.3; 36/96; 36/113

(58) Field of Classification Search ..... 36/8.3, 36/96, 86, 33, 102, 91, 113, 170, 117.9, 118.1
See application file for complete search history.

(56) References Cited

U.S. PATENT DOCUMENTS

| | | | | | |
|---|---|---|---|---|---|
| 1,528,265 | A | * | 3/1925 | Roa | 36/85 |
| 3,645,017 | A | * | 2/1972 | Hickmann | 36/117.4 |
| 4,920,665 | A | * | 5/1990 | Pack et al. | 36/117.2 |
| 4,955,149 | A | * | 9/1990 | Ottieri | 36/117.8 |
| 5,572,806 | A | * | 11/1996 | Osawa | 36/117.4 |

* cited by examiner

*Primary Examiner*—Ted Kavanaugh
(74) *Attorney, Agent, or Firm*—Richard A. Joel, Esq.

(57) ABSTRACT

The invention is a Pointe shoe for ballet. It has a rigid mid-foot section and a rigid toe loop connected by a transverse axis joint located at the metatarsal-phalange joint (M-P). With the foot in Pointe position, the weight of the dancer is supported by the rigid mid-foot section. The downward force is passed through the M-P joint to the front of the toe loop. None of the weight of the dancer needs to be supported by the toes. In contrast, prior art Pointe shoes have a rigid shank and toe cup to assist the toes in supporting the weight of the dancer. The toes have small bones, muscles, and ligaments. This often results in pain and injury to the toes. The shoe of the invention has a mid-foot section that is shaped with support surfaces for the sole of the heel bone and the dorsal side of the cuneiform and metatarsal bones. These bones are larger and stronger than the bones of the toes. This shoe provides a larger area of bone and tissue to support the weight of the dancer on Pointe. It is more comfortable to use and results in fewer injuries.

16 Claims, 11 Drawing Sheets

RIGID ARTICULATED POINTE SHOE

BACKGROUND OF INVENTION

This invention relates to a Pointe shoe used by ballet dancers. It has two rigid sections connected with a transverse joint located at the base of the toes.

For the last century the basic rigid structure of support for Pointe shoes has remained the same. It is a toe box with a shank that helps the toes support the weight of the dancer on Pointe position. All, but the first reference cited, were generally chosen because they represent the most recent description of Pointe shoe designs. In U.S. Pat. No. 1,704,281, Salvatore Capezio writes in 1927, "As is well known. Ballet or dancing slippers embody a stiffened or box toe structure designed specially to support or sustain the thrust and weight of the dancer in toe dancing position." More recently in, 1997, U.S. Pat. No. 5,682,685 describes a similar structure using materials and concepts of construction common for sport sneakers. In the last sentence of the Abstract, the inventor, Terlizzi, writes: "To stiffen the shoe body, a toe box is provided in the front portion of the shoe upper".

In both patents, a toe cup is attached to a stiff sole or shank. This structure provides the longitudinal and lateral support to hold the toe bones in alignment with the metatarsal bones. Prior art teaches the use of various materials and structures of a toe cup to cushion and support the toes en pointe position. Nearly all the weight of the dancer passes thought the tips of the toes. This concentrates the force of gravity to a very small area of bone and tissue. Standing in Pointe is a painful technique to learn and results in many foot injuries. In particular, ballet dancers often suffer from arthritis, bunions, hammertoes, and bruised or lost toenails. The thin light bones, joints, ligaments, tendons, and muscles of the toes have not evolved to continually support the weight of the body. Failure and injury to the toes of the feet, is the result of excessive levels of physical force over extended periods of time.

Another limitation of the prior art is the inability of a dancer to flex the toes when not en Pointe. In the classic Pointe shoe design of Capezio, U.S. Pat. No. 1,704,281 the toe box is held in line with the metatarsal bones by a stiff shank in the sole of the shoe. This makes it impossible to flex the toes up or down relative to the metatarsals. It holds the toes in extended or Pointe position. Some flexing up is achieved by the dancer softening the shank at the base of the toes by repeatedly bending the shank before wearing a new pair of Pointe shoes. Flexing up is necessary for walking, running, jumping and the demi-Pointe position. Flexing the toes down is necessary for the tendu and B+ foot position.

Two patents in 1997 describe Pointe shoes using materials and structures that are designed to permit some flexing at the base of the toes. U.S. Pat. No. 5,649,373 uses a spring steel shank that assists the dancer in rolling the foot from a position flat on the floor to the Pointe position. The toes are held in extended position except during the roll up, walking, and running. During these steps, the diagonal force of the weight of the dancer is applied to the plantar surface of the toes. The shoe is too stiff to permit flexing of the toes up or down for the demi-Pointe or tendu positions. In the sneaker Pointe shoe, U.S. Pat. No. 5,682,685, discussed above, the shank is replaced with a stiff segmented sole from the toes to the heel. The top of the toe cup is removed, leaving only the sides. The side of the toe cup is notched to permit the toes to flex up. This assists in walking. The stiff sole is designed to prevent all downward flexing of the toes and the tendu foot position.

Prior art teaches that Pointe shoes use a toe cup and a shank or a stiff sole to assist the dancer to stand on the tips of the toes in Pointe position. The following are of interest:

U.S. Patent Documents.

U.S. Pat. No. 1,704,281 March, 1929 Capezio 36/113.

U.S. Pat. No. 3,963,251 June, 1976 Miano 280/843.

U.S. Pat. No. 5,035,069 July, 1991 Minden 36/113.

U.S. Pat. No. 5,101,579 April, 1992 Terlizzi 36/8.3.

U.S. Pat. No. 5,111,597 May, 1992 Hansen 36/8.3.

U.S. Pat. No. 5,649,373 July, 1997 Winter 36/8.3.

U.S. Pat. No. 5,682,685 November, 1997 Terlizzi 36/8.3.

Other Publications.

Discount Dance Supply, 5065 E. Hunter Ave., Anaheim, Calif. 92807 Holiday 2002 catalogue.

SUMMARY OF INVENTION

The objective of the invention is to construct a pair of shoes that gives the freedom of movement and feel of the dance floor similar to a "Ballet Slipper" and to do this while providing sufficient support to assist the dancer to go on Pointe. This is to be accomplished without passing the weight of the dancer through the toes. The terms "Pointe shoe" and "ballet slipper" are not distinguished in the patent literature cited in the above Background of the Invention. In contemporary dance literature a "Pointe shoe" has a rigid toe box and shank. The sole is split leather with a satin top and sides. A "ballet slipper" has a split leather sole with a soft top and sides of leather or canvass. It has no rigid parts. These definitions are used in this application and are herein referenced in the Discount Dance Supply catalogue pages 1–15.

The shoe of this invention accomplishes the above goals with several rigid structures and a connecting mechanisms. The form and strength of the structures, and the design of the transverse axis at the base of the toes, distinguish the invention from the prior art, i.e., a toe box and shank.

An object of the invention is to lessen the downward force on the toes with the dancer's foot in Pointe position. This is accomplished by supporting the weight of the dancer with a rigid mid-foot section. This section is contoured to support the weight of the dancer on the sole of the heel bone and the top of the mid-foot and metatarsal bones. The downward force on the mid-foot element of the shoe is then transferred to the rigid toe loop section through a transverse axis near the base of the toes. The toes are suspended off the floor and are not needed to support the weight of the dancer en Pointe. This relieves the high loads of force on the toes to support the weight of the dancer. It reduces pain and injury caused by standing and turning on the points of the toes.

The structure of the inventor's shoe supports the weight of the body using the larger, stronger heel and mid-foot bones. These bones have evolved to support the weight of the body when standing walking, running, jumping, turning, and on demi-point position. The bones, joints, ligaments, tendons, and muscles of the heel, cuneiform, and metatarsals are larger and stronger, then the bones, joints, ligaments, tendons, and muscles of the toes. The surface area of the heel and mid-foot bones covers a far greater area, then the tips of the toes. This significantly reduces the amount of force on any particular area of bone. The shoe of the invention is less painful to use and results in fewer injuries to the foot.

Another object of the invention is to provide a feel of the dance floor by the sole of the foot similar to a "ballet slipper." This is accomplished by reducing the sole of the shoe, or shank, from just behind the front of the metatarsals to the front of the heel bone. There is also a cutout section for the back of the fifth metatarsal. This gives the dancer better proprioception of the center of mass of the body supported by these foot bones. Sensory receptors in the muscles, tendons, and joints help the dancer locate the various positions of the body parts through internal stimuli. Changing the pressure on the plantar surface of these foot bones with direct contact with the dance floor helps the dancer maintain balance. Prior art Pointe shoes isolate the foot from the floor with a stiff shank. This makes maintenance of balance more difficult, especially when doing steps, turns, kicks, and jumps.

Another object of the invention is to design the mechanism of the transverse joint, so that the flexing of the shoe near the base of the toes is similar to the prior art. There is a long history of choreography, steps, and foot position that has been developed to fit the mechanics of prior art Pointe shoes. In this case the shoe of the invention provides a more comfortable, injury free alternative for Pointe position. It also offers better proprioception because the support bones of the foot have direct with the floor.

Another object of this invention is the design of a self-locking and self-releasing transverse joint at the base of the toes. This would permit steps and foot position similar to a "ballet slipper." When on Pointe the joint is locked in place by a retractable pin. The rigid mid-foot section is held in a vertical position with respect to the toe loop. The weight of the dancer is transferred from the support surfaces of the mid-foot section to the front of the toe loop and to the floor. When not on Pointe position, the transverse axis can disengage and permits free movement of the toe loop in relation to the mid-foot segment of the shoe. The foot position of demi-Pointe, tendu, and B+ are now possible. These positions are possible with a "Dance Slipper" and are not possible with prior art "Pointe Shoes." The shoe of this invention offers new foot positions and new choreography.

Another object of the invention is to construct the shoes in a style similar in appearance to prior art Pointe shoes and ballet slippers. Possible shoe styles may include: modern sandals, jazz shoes, and contemporary dance sneakers. With a more comfortable Pointe shoe, dancers other then ballet dancers may want to learn Pointe technique.

Prior art teaches the use of a rigid toe box and shank to assist the dancer in supporting the weight of body with the foot in Pointe position. The invention teaches the use of a cone shaped rigid mid-foot element and an articulated toe box to assist the dancer in supporting the weight of the body with the foot in Pointe position. This is a new and novel structure and mechanism for the construction of a ballet Pointe shoe.

BRIEF DESCRIPTION OF DRAWINGS

The above and other objects of the invention may be more readily seen when viewing in conjunction with the accompanying drawings wherein.

DETAILED DESCRIPTION

Figure 1:
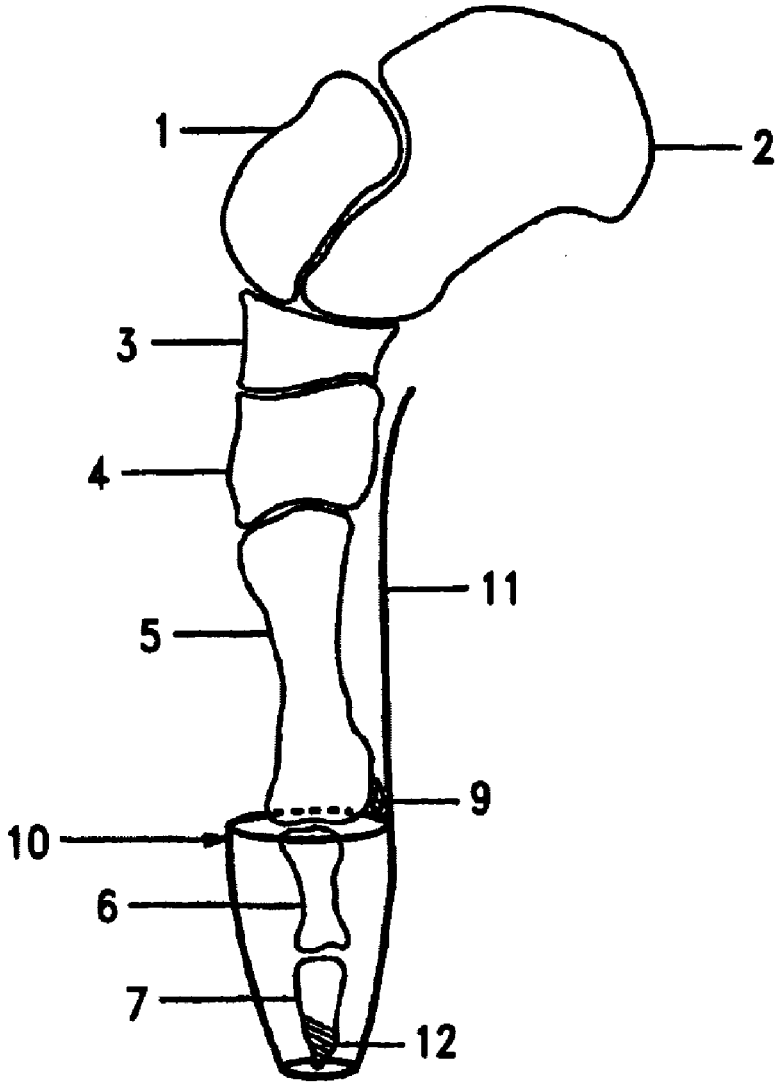
FIG. 1 (PRIOR ART)
FIG. 1 is a schematic side view of "prior art" with the bones of the foot in Pointe position.
Figure 2:
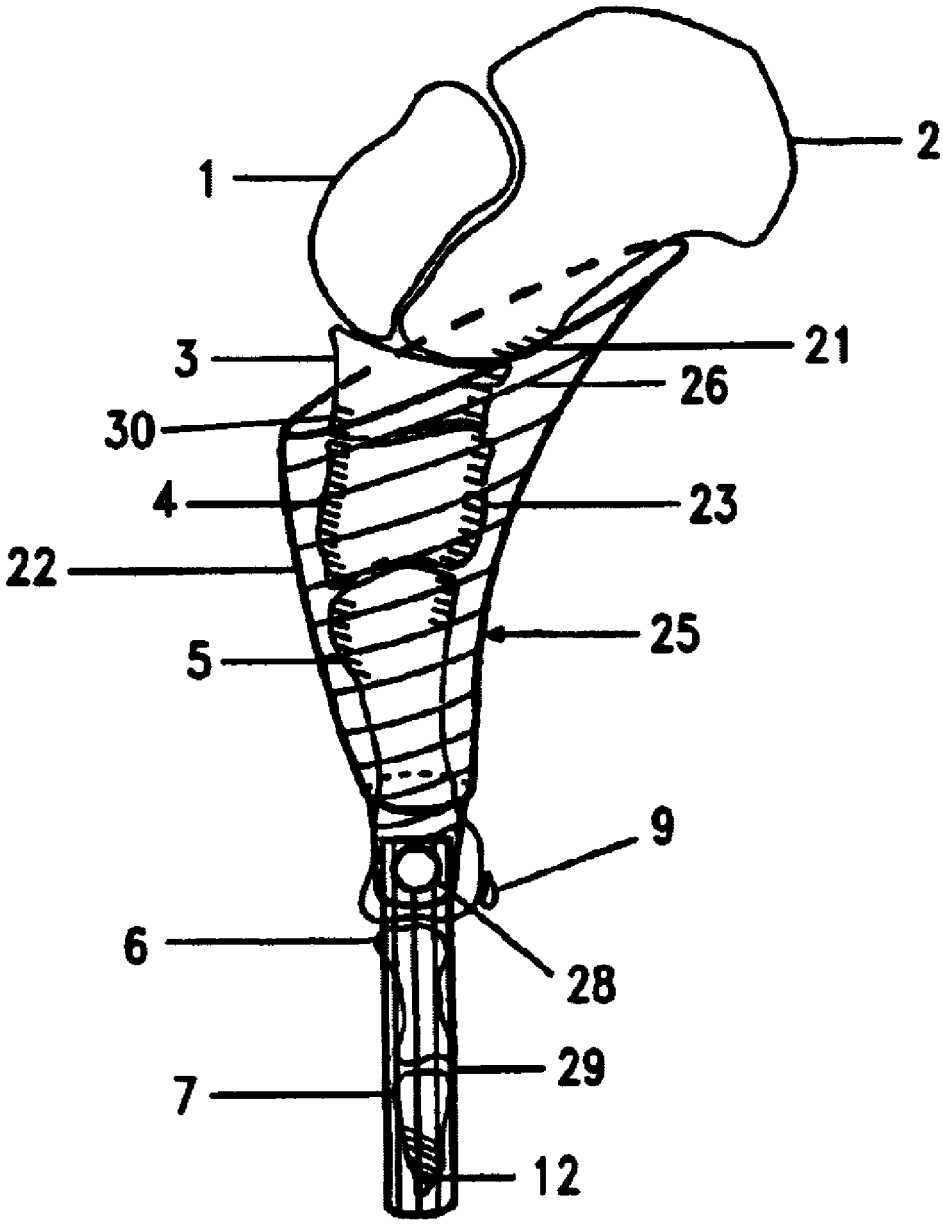
FIG. 2 is a schematic side view of "the invention" with the bones of the foot in Pointe position.

FIG. 1 "prior art" and FIG. 2 "the invention," are side views of the medial bones of the right foot for comparing the corresponding shoe structures that support the foot in Pointe position. The bones along the big toe side of the foot are top to bottom: talus 1, calcaneus 2, navicular 3, cuneiform 4, metatarsal 5, phalanges 6, phalanges 7. The foot may be divided into three sections: a heel section (calcaneus 2) at the back, a mid-foot section having five bones, and the nineteen bones of the front of the foot. The five mid-foot bones are: one navicular 3, three cuneiform 4, and one cuboid bone not shown. The ball of the foot 9 is located at the front of the big toe metatarsal and has two small sesamoid bones. The big toe shown has two phalanges 6, 7, while the rest of the toes have three phalanges each, which are much smaller and weaker, and not shown.

In FIG. 1, the classic Pointe shoe has a rigid shank 11 from the tip of the toes 12 to the back of the arch at the front of the heel bone 2. The rigid toe cup 10 is shaped to hold the 14 toe bones as a single structural unit. The toe cup 10 and, the five metatarsals are secured to the shank 11 by a flexible top and sides. Elastic straps, not shown, secure the heel and arch of the shoe to the ankle area of the mid-foot bones.

The weight of the dancer passes down the tibia and fibula of the leg through the talus 1 and heel bone 2, to the mid-foot bones 3, 4, the metatarsals 5, and then to the toe bones 6, and 7. Nearly all of the weight of the dancer is supported by the small surface area of bone indicated by 12 at the tip of the toes. Although this shoe structure facilitates standing on Pointe, the toe bones, tendons, and ligaments are not sufficiently strong to continually support the weight of the dancer. Dancing on Pointe using a shoe based on the "prior art" design is painful and may result in injuries to the foot. Another restriction of this design is the rigid shank. It prohibits the flexing of the toes relative to the metatarsals. This flexing is used for walking and demi-Pointe (toes up), and tendu (toes down) among other foot positions.

In FIG. 2 a schematic of the invention, the weight of the dancer passes down the tibia and fibula of the leg through the talus 1 and the heel bone 2. The downward force first contacts the surface of the shoe at the support area 21 on the sole of the heel bone 2. The remainder of the weight is supported by area of bone indicated by 22 on the dorsal side of the foot. Additional weight of the dancer is also supported by area 23 on the sole side of the mid-foot bones 3, 4, and the back end of the metatarsals 5. These bones are larger and these tendons and ligaments are stronger then the toes. This shoe is more comfortable to wear, and may result in fewer injuries to the foot, especially to the bones, ligaments, muscles, and tendons of the toes. The areas of support are located on the inside surface of the rigid mid-foot segment 25. It is a truncated cone 26 with a base opening 30 located near the heel bone. The front ends of the metatarsals pass through a smaller opening 27 at the truncated apex of the cone. All the weight of the dancer passes through the joint 28 to a toe loop 29 directly to the floor.

None of the weight needs to be supported by the toes. This is an advantage over the prior art of FIG. 1. With a lock axis joint 28 engaged in a vertical position, the two rigid elements 25 and 29 acts as one rigid shoe. When the weight of the dancer is not passing vertically down to the floor, the lock joint 28 releases and is free to move. This permits the flexing of the toes relative to the metatarsals, for walking running and the foot positions of demi-Pointe, and tendu. Transverse joint 28 at the base of the toes may also be spring loaded to replicate the flexing and form of the prior art in response to the weight of the dancer.

Figure 3:
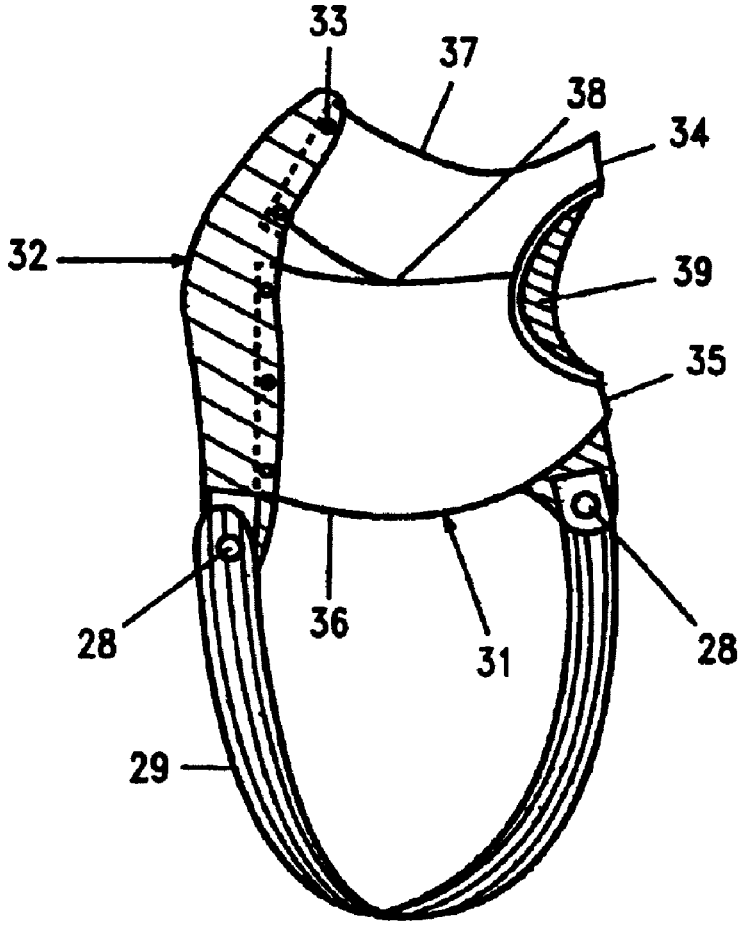
FIG. 3 is a perspective drawing of the sole plate and the toe loop in Pointe position.

FIG. 3 is a perspective drawing of a first embodiment of the invention with the shoe in Pointe position. It is a view of the sole area of the shoe from the big toe side of the right foot. The mid-foot section 25 in FIG. 2 has of two rigid parts. The arch plate 31 is divided into two sections by a bend and notch 38. This helps to adjust the arch plate 31 to the shape of the foot. Area 36 supports the metatarsals of the forefoot arch, while area 37 supports the heel of the back part of the arch. The arch plate 31 is attached to the dorsal plate 32 at attachment points 33. The arch plate 31 is secured to the dorsal plate on the lateral side of the foot by straps 34 and 35. Area 39 between straps 34 and 35 permits the tuberosity at the back end of the fifth metatarsal to be free of the constricting forces of the shoe. It also permits contact of the fifth metatarsal with the floor when the foot is flat on the floor.

Figure 4:
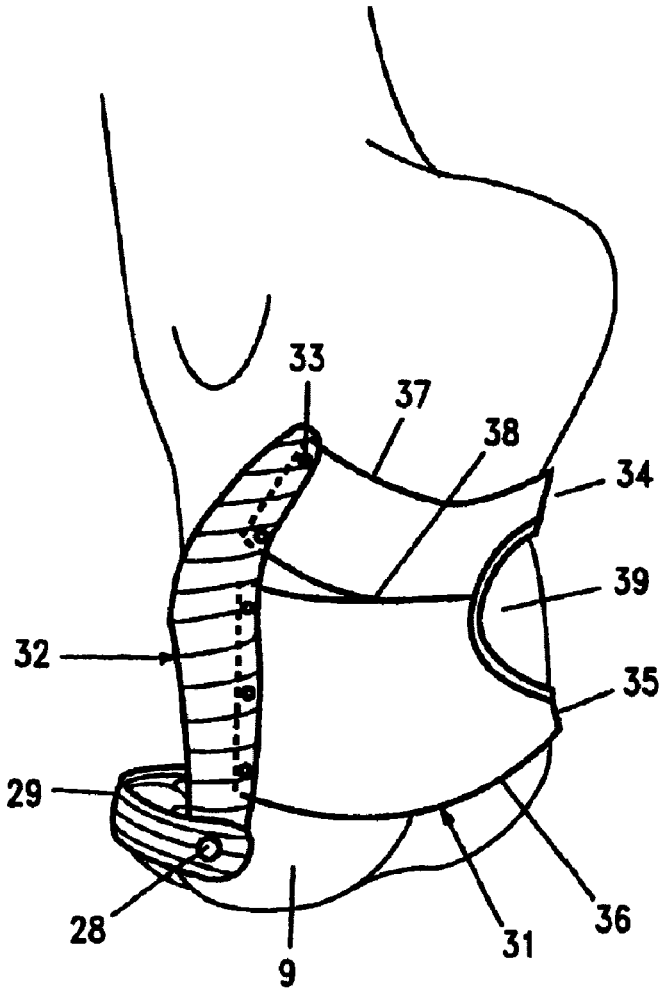
FIG. 4 is a perspective drawing of the shoe with the foot in demi-Pointe position.

FIG. 4 is a drawing of the shoe with the foot in three-quarter position, often called demi-Pointe in class or choreography. The joint 28 is in an unlocked position permitting the toes to be bent in an up position. The weight of the dancer is supported on the front end of the five metatarsals. When turning, all the weight is supported by the ball of the foot 9. The semi-flexible arch plate 31 is designed to allow maximum contact of the support surfaces of the foot bones with the floor. When standing flat-footed these bones are: the front of the metatarsals, the back end of the fifth metatarsal, and the back sole surface of the heel bone. A notch 39 allows the back end of the small toe metatarsal to have contact with the floor. The toes are isolated from the floor by a toe cup shown in FIG. 5. The sensation of the floor through the bones of the foot helps in the maintenance of balance through directed force to these bone surfaces. The stiff shank and toe cup of a prior art Pointe shoe isolates the foot from the flat surface of the dance floor, which makes balance and dance steps more difficult. This difference is an advantage of the present design.

Figure 5:
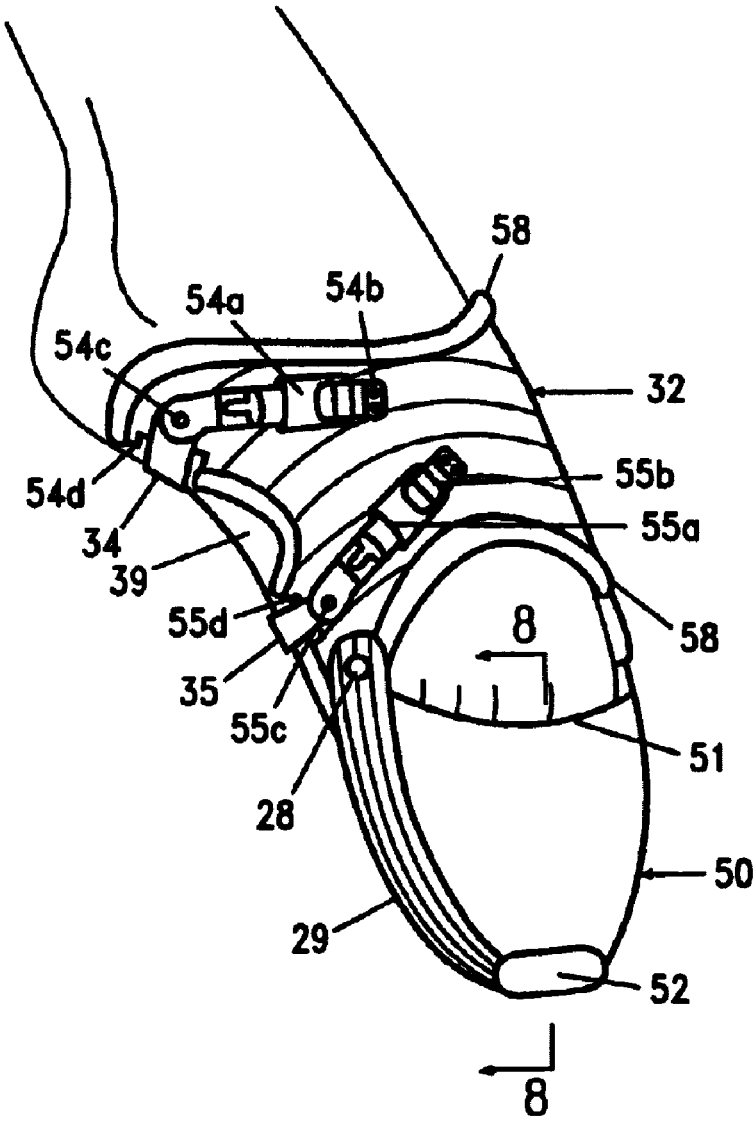
FIG. 5 is a perspective drawing of the dorsal plate and toe box with the foot in tendu position.

FIG. 5 is a perspective drawing with a view of the top and lateral side of the shoe with the right foot in tendu position. Buckle 54*a* is secured to the dorsal plate 32 at attachment points 54*b* and to strap 34 by attachment pin 54*c*. Strap 34 is secured in a longitudinal direction by the notch 54*d* to the dorsal plate 32. Adjustment of buckle 54*a* changes the size of the base cone 26 in FIG. 2 and the transverse constricting forces on the foot. The base cone 26 comprises the arch plate 37, strap 34, and dorsal plate 32 which apply force to the back end of the metatarsals, the mid foot bones, and the front of the heel bone. Buckle 55*a*, is connected to dorsal plate 32 and strap 35 by attachments points 55*b* and 55*c*. Notch 55*d* secures the strap in a longitudinal direction to the dorsal plate 32. Adjustment of buckle 55*a* changes the size of the opening at the apex of the cone 27 in FIG. 2 and the transverse constricting forces on the font end of the metatarsals. This opening at the truncated apex of the cone includes buckle 55*a*, strap 35, and arch plate 31. Releasing the buckles, 54*a* and 55*a* permits ingress and egress of the foot. Notch 39 provides an opening to relieve the constricting forces of the shoe on the tuberosity of the back end of the fifth metatarsal.

Figure 11:
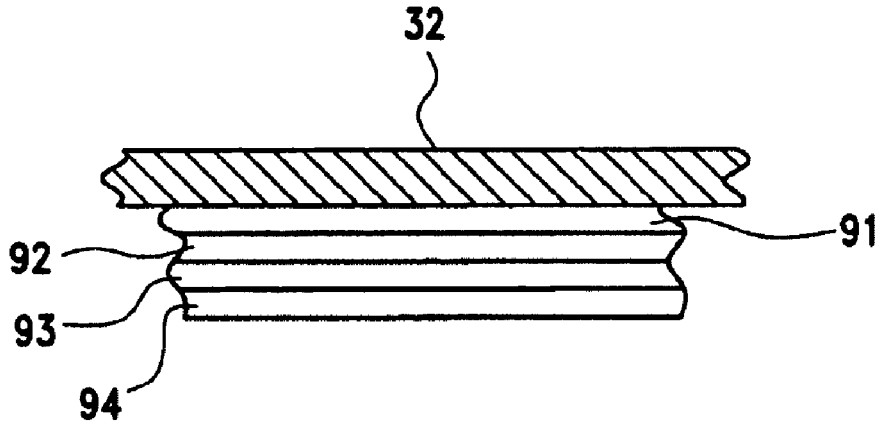
FIG. 11 is a plurality of liners.

A toe cup or box 50 encloses the toes and provides a means for the toes to control the direction of rotation of the toe loop 29 about the transverse axis 28. The rigid structure of the toe cup 50 comprises the toe loop 29, and the rigid top shell 51. The front end has a slightly rounded square surface 52, which helps the dancer maintain Pointe position. A cross section view indicated by the set of bent 8 arrows is viewed and discussed as FIG. 8. The shoe generally includes a plurality of liners as shown in FIG. 11. Thus liners comprise a sense shaping material 93, a cushioning material 94, an inner liner 91 for ease of ingress and egress and an inner non-slip liner 92 for stabilizing the shoe position when secured to the foot.

Figure 6C:
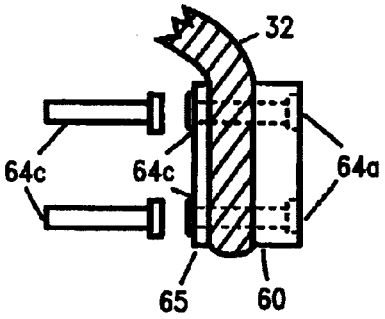
FIG. 6B a side view of the inner attachment plate and FIG. 6C is front view of the control plate and inner plate secured to the dorsal plate.
Figure 6A:
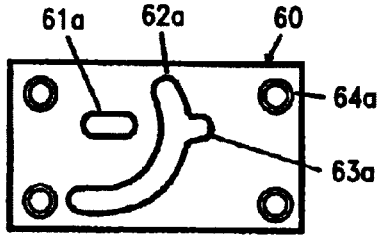
FIG. 6A is a side view of the control plate for a lock axis joint.
Figure 6B:
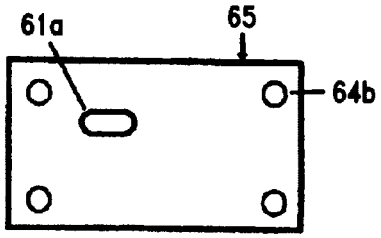
Figure 6D:
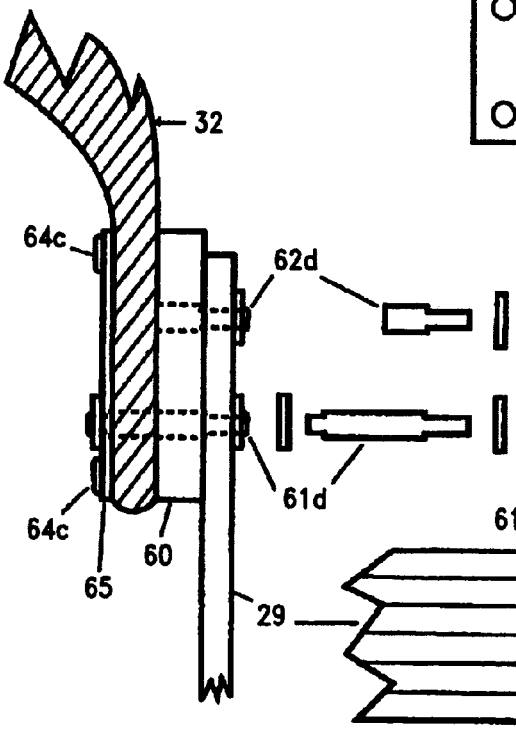
FIG. 6D is a front view of an assembled lock axis joint in Pointe position.
Figure 6E:
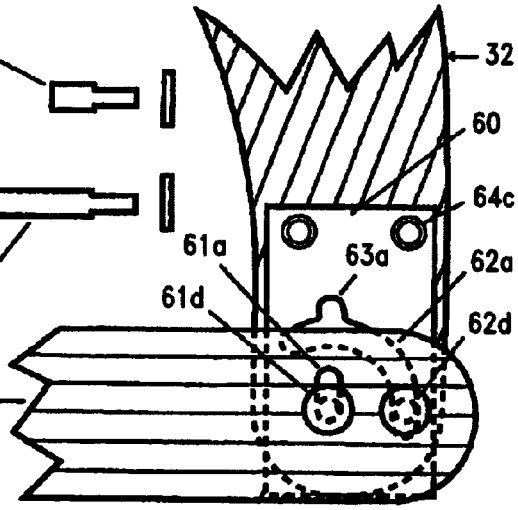
FIG. 6E is a side view of the lock axis joint in demi-Pointe position.

FIGS. 6A through 6E is an enlarged and detailed set of drawings of the parts and an assembled lock axis joint as located by part 28 in FIGS. 2, 3, 4, and 5 near the right big toe. A description of parts, function, and assembly follows in alpha and numeric order of the figures and parts. Control plate 60 has an elongated axis hole 61*a* for axis pin 61*d* attached to the toe loop 29. This pin holds the toe loop to the mid-foot element of the shoe. The circular shaped control guide 62*a* limits the rotational motion of the control pin 62*d* attached to the toe loop 29. When control pin 62*d* is positioned at the locking notch 63*a*, the axis joint is locked. The mid-foot element and the toe loop act a single structural unit. There are four counter sunk holes 64*a* at the corners for the pins 64*c*. They attach the control plate 60 and the inner plate 65 to the dorsal plate 32 of the shoe. Inner attachment plate 65 has an axis hole 61*a* and four holes 64*b* for the attachment pins 64*c*. FIG. 6C is a front edge view of the control plate 60 and inner plate 65 attached to the dorsal plate 32 with the foot flat on the floor. FIG. 6D is a front view of the assembled joint in lock position with a foot in point position. The same foot position has been shown and discussed in FIGS. 2 and 3. In FIG. 6D the dancer's foot in Pointe position is pressing down on the front of the toe loop 29 against the floor. This force pushes the control pin 62*d* up into the lock notch 63*a*. The axis is locked, and the two segments of the shoe act as a solid unite. The weight of the dancer is supported by the sole of the heel bone and the top of the mid-foot bones. When the weight of the dancer is removed, the inner cushioning material of the toe box 50 pressing against the tips of the toes retracts the control pin 62*d* into the circular part of control slot 62*a*. The toes are now free to move from demi-Pointe to tendu position. The longer arc of 62*a* toward the bottom limits the toe in the demi-point position. The shorter arc to the top is the limit for the tendu position. FIG. 6E shows a side view of the joint in unlocked demi-Pointe position as previously shown in FIG. 4. The weight of the dancer is supported on the ball of the foot. The foot positions, tendu and point, are not possible in "prior art" discussed in FIG. 1. An advantage of the invention provides new options for ballet choreography.

Figure 7C:
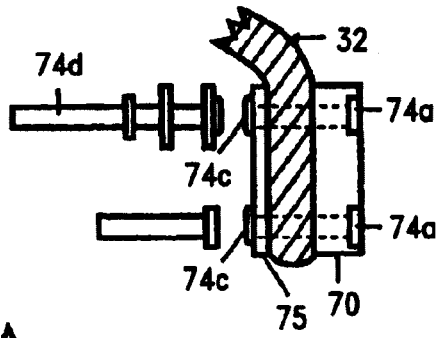
FIG. 7B a side view of the inner attachment plate and FIG. 7C is front view of the control plate and inner plate secured to the dorsal plate.
Figure 7A:
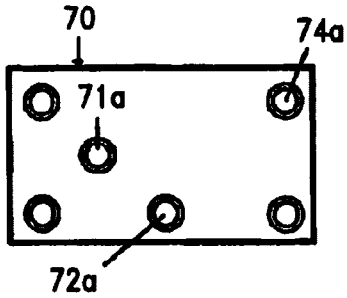
FIG. 7A is a side view of the control plate of a spring-loaded axis joint.
Figure 7B:
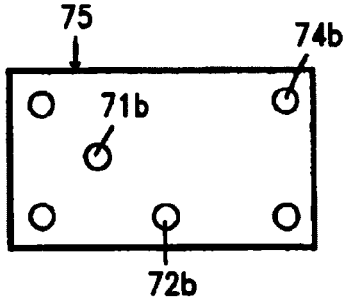
Figure 7D:
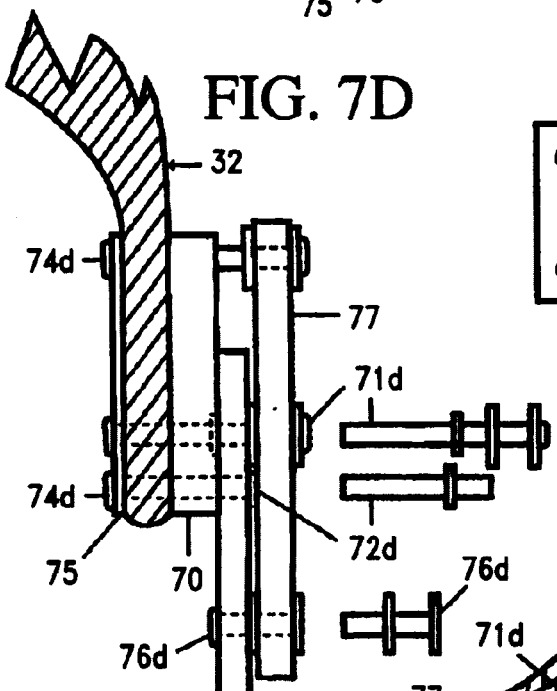
FIG. 7D is a front view of an assembled spring-loaded axis joint in Pointe position.
Figure 7E:
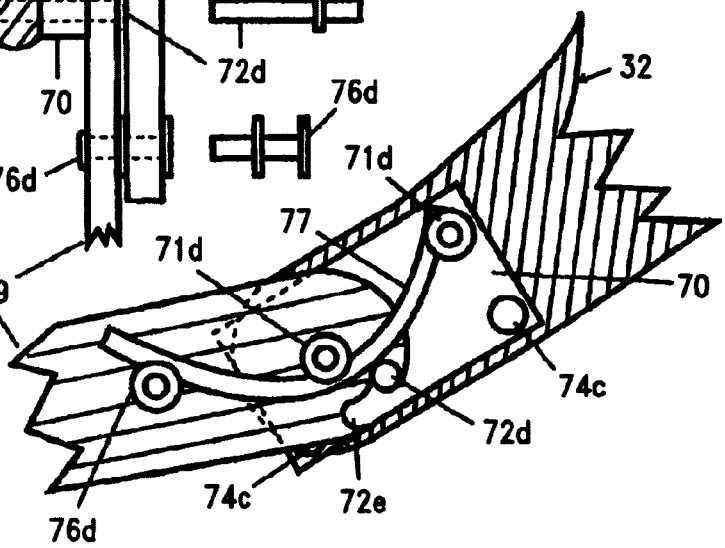
FIG. 7E is a side view of the spring-loaded axis joint in full load position.

FIGS. 7A through 7E is a set of drawings of the parts and an assembled spring-loaded axis joint. It is a detailed drawing of part 28 in FIGS. 2, 3, 4, and 5. The foot positions of demi-point FIG. 4 and tendu FIG. 5 are no longer possible with this joint design. The spring loaded axis joint is designed to respond similarly to "prior art" in its response to weight applied diagonally downward on the toes. With toes extended the foot is between flat on the floor and Pointe position. When a dancer rolls up to Pointe position, walks or lands from a jump, there is some flexing up of the toes and the shoe. In "prior art" the stiffness of the shank controls the amount of flexing of the shank at the back of the toe box. Spring 77 in FIGS. 7D and 7E replaces the function of the shank in "prior art." It provides the modulated mechanical resistance to the weight of the dancer. A best mode-contemplated would comprise a multi-layered spring. A description of parts and function follows. Control plate 70 has an axis hole 71*a* for axis pin 71*d* attached to the toe loop 29. Hole 72*a* is for the rotational control pin 72*d*. There are four counter sunk holes 74*a* at the corners that are used by three pins 74*c* and one pin 71*d* for attaching the control plate 70 and the inner plate 75 to the dorsal plate 32 of the shoe. The inner attachment plate 75 has an axis hole 71*b* for the axis pin 71*d* and four holes 74*b* for the attachment pins 74*c* and 71*d*. FIG. 7C is a front and edge view of the control plate 70 and the inner plate 75 attached to the shoe 32 with the foot flat on the floor. FIG. 7D is a front view of the assembled spring-loaded joint with the foot in Pointe position. FIG. 7E is a side view with the dancer applying maximum pressure diagonally to the bottom of the toes. Toe loop 29 is deflected up by the floor surface and the downward force applied by the dancer's foot. This results in a maximum curvature of the spring 77. It is attached to pin 71*d*, at the upper right corner, and is depressed downward by axis pin 71*d*, and pushed up by the toe loop pin 76*d*. The movement of the toe loop 29 is limited by the position of the control pin 72*a* in slot 72*e*. This joint design of the shoe is compatible with the steps, foot positions and choreography of prior art Pointe shoes.

Figure 8:
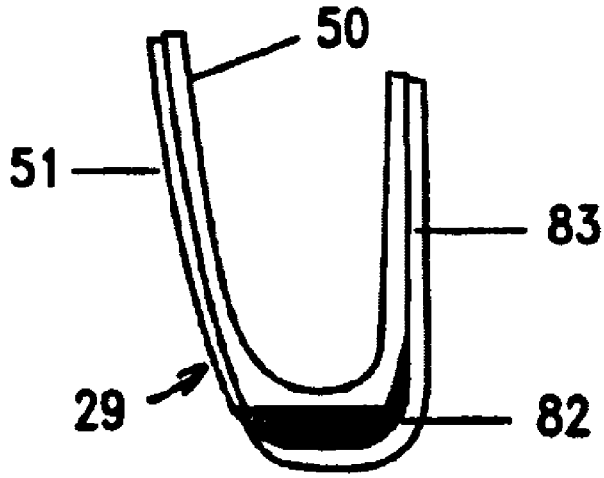
FIG. 8 is a cross section of a toe cup.

FIG. 8 is a cross section view of a toe cup indicated in FIG. 5. A cup 50 comprising shaping and cushioning materials are attached to the inside surface of the toe loop 29. A dense impact absorbing material 82 is attached to the front surface and plantar edge of the toe loop 29. A layer of less dense impact absorbing material 83 covers the front surface and plantar edge surface of the toe loop 29 and the sole surface of the toe cup 81. This version provides a feeling for the dance floor by the toes that is similar to a toe cup of a prior art Pointe shoe. An alternate toe cup has a split leather sole. It would provide a feeling for the floor similar to a ballet slipper.

Figure 9:
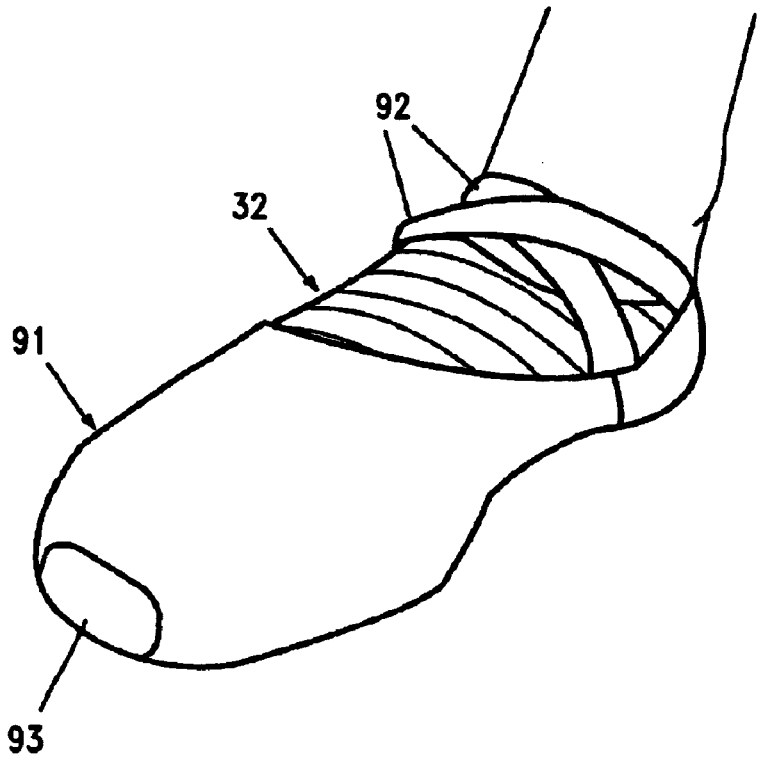
FIG. 9 is a three quarter view of the shoe with an outer covering.

FIG. 9 is a front three quarter view of a "ballet slipper" 91 that has been put on over the shoe FIG. 5. A ballet slipper has no hard parts. It has a top and sides of soft leather or canvas and a split leather sole. Elastic straps 92 secure the ballet slipper 91 to the heel, the arch, and the front of the ankle. The front of the toe cup 52 creates a flat area 93 at the front of the shoe. The "ballet slipper" provides the shoe of the invention with a ballet style upper and sole. A better fit of the outer covering can be achieved by shaping the ballet slipper 91 to fit a foot and the rigid structure of the invention. Replacing the leather or canvas upper 91 with satin, and the elastic straps 92 with satin ribbons would provide a shoe similar in style to a "Pointe shoe." Those familiar with the construction of dance shoes could easily adapt the shoe of this invention to other dance techniques. A most useful adaptation could be a sandal used in modern dance. It consists of a split leather sole held on by straps over the top of the foot. It could be used to secure the ball of the foot to the shoe of the invention in the area near the lateral axis joint. Jazz dance shoes with their thin soles and soft-top and sides offer another style for the outer covering of the shoe of the invention. Dance sneakers would provide the most comfortable outer covering for the shoe of this invention. With their semi-flexible, segmented soles with a cushioned inner liner, they offer the most protection against foot injury. This would be especially true when landing from jumps.

The Discount Dance Supply catalogue is herein referenced as a source of information for the numerous styles of dance shoes available for adaptation with the present shoe of invention.

Figure 10:
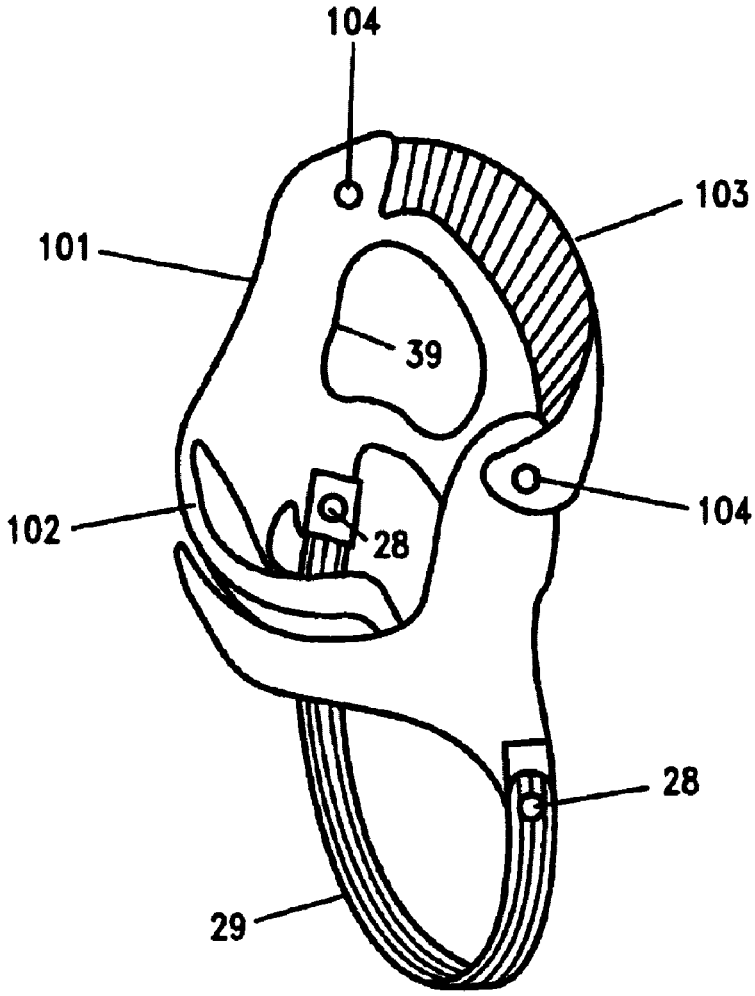
FIG. 10 is an upper side view of the shoe with a design similar to a ski boot.

FIG. 10 is a best mode-contemplated sketch of the shoe in Pointe position. This top medial view is similar to FIG. 3. Most of the shoe structure comprises the large complex or midfoot part 101. It has a semi-flexible sole similar in shape to part 36. The sides are rigid and extend into flexible overlapping top section that encloses the rigid tongue 102. This structural form is used in ski boots. A shoe design, that secures a foot comfortably, when high longitudinal and lateral forces are applied to a ski by the foot through the boot. The heel support 103 is equivalent to part 37 of FIG. 3. It is attached to the side of 101 at the two lateral axis points 104. It is free to rotate with the sole of the heel bone 2. The shoe has three rigid sections: a mid-foot 101, a heel support or loop 103, and a toe loop 29. This allows the rigid parts of the shoe to better adjust to the bones of the foot from flat on the floor to Pointe position. A reverse of the structure from top to bottom top is also a likely alternative. The top of the shoe is rigid like FIG. 3 to FIG. 5. There is a semi-rigid arch plate attached to the medial side of the shoe. The sides of the shoe are made more flexible as they extend to overlap and enclose the arch plate and secure it to the sole of the foot.

Several preferred embodiments of the Pointe shoe of invention has been described. Those skilled in the art of dance shoe construction, prosthetic devices, and athletic equipment may recognize the structures, mechanisms, and materials used in these embodiments of the invention. There are many other variations and modifications that will become apparent. The present invention is not to be limited by the specific disclosure herein, but by the proper scope and fair meaning of the accompanying claims.

What is claimed is:

1. A Pointe shoe for a dancer's foot to provide support and freedom of movement on the dance floor comprising:

a rigid mid-foot element having support surfaces for; the plantar of the heel bone, for the top of the mid foot bones, and for the top of the metatarsal bones, said mid-foot segment including means for securing it to the foot;

a rigid toe loop having one end mounted to the mid-foot element for transferring the downward force on the mid-foot segment to the dance floor and having a second end in contact with the dance floor in a Pointe position; and a transverse joint mounting the rigid mid-foot segment to the rigid toe loop on both sides of the foot forming a single structural unit said joint being located at the base of the toes to permit flexing thereof and wherein said structural unit transfers the weight of the dancer to the front end of the shoe, and then to the floor with the foot in Pointe position.

2. A Pointe shoe comprising:

a rigid conical form with a large opening at one end near the back of the arch, and a smaller opening at the other end just behind the ball of the foot for putting on and taking off said shoe, said conical form supporting the weight of the dancer with the foot in Pointe position;

a toe cup mounted to the conical form for supporting the downward force applied to said conical form with the foot in Pointe position; and a transverse rotational mounting means for joining the conical form to the toe cup located near the ball of the foot and permitting the toe bones to flex relative to the metatarsal bones, said mounting means including means to maintain a vertical position with the foot in Pointe position, wherein the Pointe shoe supports the weight of the dancer on the mid-foot bones, the metatarsal, and heel bone, and said downward weight force is transferred to the dance floor.

3. A Pointe shoe in accordance with claim 2 wherein:

the toe cup comprises a rigid structure having a flat front surface to facilitate balancing on Pointe and having sides extending therefrom.

4. A Pointe shoe in accordance with claim 2 wherein:

the toe cup includes a U-shaped toe loop extending along opposite sides thereof, an impact absorbing front surface and an inner liner extending along the sides.

5. A Pointe shoe in accordance with claim 2 wherein:

the toe cup includes a toe loop and straps to secure the box to the toes.

6. A Pointe shoe in accordance with claim 1 wherein:

the mid-foot element comprises an arch plate truncated conical element extending from behind the ball of the foot to the beginning of the heel bone and from one side of the foot to the other, said element being shaped to support the weight of the dancer.

7. A Pointe shoe in accordance with claim 6 further including:

a semi-rigid plate having a support surface on the arch for the plantar and mid-foot bones.

8. A Pointe shoe in accordance with claim 6 wherein:

the mid-foot element comprises rigid side portions joined by a right top tongue, said element extending from the ball of the foot to the back of the mid-foot bones on both sides and a rigid plate connected thereto forming a support surface for the top mid-foot bones and metatarsal bones and further including straps and a buckle to secure the shoe to the foot.

9. A Pointe shoe in accordance with claim 8 further including:

a transverse rotational joint that attaches the mid-foot elements to the front foot elements, said joint being self-locking and releasing by applying and removing force to the front of the toe cup.

10. A Pointe shoe in accordance with claim 1 further including:

a self locking and releasing pin located on a plate mounting the mid-foot element to the toe cup.

11. A Pointe shoe in accordance with claim 1 wherein:

the joint permits fully flexing of the toes down (tendu) to toes up (demi-point), said joint being lockable in the vertical position to transfer the weight of the dancer through the mid-foot element to the toe cup and then the dance floor.

12. A Pointe shoe in accordance with claim 1 wherein:

the transverse joint provides rotation of the fore front element with regard to the mid-foot element said joint further including a control plate mounting said elements together, a spring mounted to the control plate at one end and a guide and pin located thereon with the spring extending about the guide and pin to control rotation of said elements.

13. A Pointe shoe in accordance with claim 1 further including:

a plurality of liners comprising a sense shaping material, cushioning material, an inner liner for ease of ingress and egress and an inner non-slip liner for stabilizing the shoe position when secured to the foot.

14. A Pointe shoe in accordance with claim 1 further including:

securing means for joining the mid-foot and toe cup elements.

15. A Pointe shoe in accordance with claim 14 wherein:

the securing means comprises at least one buckle having a first end and a second end one end being mounted to the mid foot dorsal plate end and the other element being mounted to the arch plate.

16. A Pointe shoe in accordance with claim 14 further including:

a plurality of straps for securing the shoe to the foot.

* * * * *